US008026202B2

(12) United States Patent
Deaton

(10) Patent No.: US 8,026,202 B2
(45) Date of Patent: Sep. 27, 2011

(54) RIFLE BORE CLEANING COMPOSITION

(76) Inventor: Carl R. Deaton, Valdosta, GA (US)

( * ) Notice: Subject to any disclaimer, the term of this patent is extended or adjusted under 35 U.S.C. 154(b) by 42 days.

(21) Appl. No.: 12/459,662

(22) Filed: Jul. 6, 2009

(65) Prior Publication Data

US 2011/0003728 A1 Jan. 6, 2011

(51) Int. Cl.
*C11D 17/00* (2006.01)

(52) U.S. Cl. ..... 510/190; 510/202; 510/499; 510/488

(58) Field of Classification Search ..... 510/190
See application file for complete search history.

(56) References Cited

U.S. PATENT DOCUMENTS 3,607,769 A 9/1971 Page
5,565,039 A * 10/1996 Wagenknecht et al. ..... 134/2
5,824,631 A 10/1998 Wagenknecht
6,077,817 A 6/2000 Pomp
2002/0004470 A1 1/2002 Wright, Jr. et al.
2007/0010414 A1 1/2007 Cioletti et al.

OTHER PUBLICATIONS

Civilian Marksmanship Program, "Sweets Bore Cleaning Solvent" CMP Discussion Forum, Nov. 20, 2008.
Jack, "Stubborn Copper Fouling!!!!!!," Beartooth Bullets/ LoadSwap.com/GunNuts.com, Jul. 3, 2008.
KANO Laboratories, Inc., "Safety Data Sheet," Aerokroil, Jun. 7, 2005, 5 pages, KANO Laboratories, Inc., Nashville, TN.
Butchlambert, "We Normally Clean . . . ," Beartooth Bullets/ LoadSwap.com/GunNuts.com, Feb. 15, 2004.
BK40SENIOR Member, "For Bore Claning . . . ," The Firing Line, Jul. 8, 2000, Mississippi.

* cited by examiner

*Primary Examiner* — Necholus Ogden, Jr.
(74) *Attorney, Agent, or Firm* — John P. Sinnott; Langdale Vallotton, LLP

(57) ABSTRACT

A rifle bore cleaning mixture of 2.4 by volume of Sweet's to 1 of Kroil to produce an approximate compound that is 70% by volume of Sweet's and 30% by volume of Kroil without combining any further additives with the mixture.

3 Claims, 2 Drawing Sheets

RIFLE BORE CLEANING COMPOSITION

CROSS-REFERENCES TO RELATED APPLICATIONS

None

FEDERALLY SPONSORED RESEARCH OR DEVELOPMENT

None

NAMES OF PARTNERS TO A JOINT RESEARCH AGREEMENT

None

REFERENCE TO "SEQUENCE LISTING"

None

BACKGROUND OF THE INVENTION

This invention relates to an improved compound for cleaning firearm bores and, more particularly, to a combination of 2.4 by volume of the fluid described in U.S. Pat. No. 5,565,039 to 1 of the Kano Laboratories, Inc. Aerokroil described in the Kano Laboratories, Inc. Jun. 7, 2005 "Safety Data Sheet," and the like.

BRIEF DESCRIPTION OF THE PRIOR ART

To clean the bore in a gun barrel is a problem that has confronted those who handle firearms as far back as the first application of black powder to guns and at all levels of use, from the recruit in basic training to the skilled competition marksman.

For example each time a rifle is fired the jacket of the projectile travelling through the rifled bore leaves a residue of metal (usually lead or copper) on the rifling. The "powder," or propellant combustion products, moreover, that drive the projectile through the rifle bore also leave a residue within the bore. This combination of residual metal and burnt powder, or "fouling" can damage the bore by attacking the metal surface in a manner that causes "pitting" and other undesirable corrosive effects. These effects not only degrade the quality of the rifle barrel, but also decrease the firearm's accuracy.

Consequently, cotton flannel patches soaked with rifle bore cleaning compounds and placed on the end of a rifle bore cleaning rod or the like are run through a bore to remove the fouling. Ordinarily, these patches each are run once through the barrel and discarded. The patches, moreover, are run through the barrel until a clean patch emerges without any apparent fouling.

The cleaning compounds, however, are not fully effective because they fail to scour the fouling from hard-to-reach parts of the bore, e.g. fouling trapped within hairline cracks or fissures in the rifle barrel, fouling stuck in the angle formed where the sides of the raised rifling (the sides of the "lands") intersect with the respective grooves that establish the maximum diameter of the rifle bore.

This failure to scour out all of the fouling is believed to be a consequence of the viscosity of these cleaning compounds in which the compound is too viscous, or "thick" to penetrate rifle bore fissures and the like in order to draw out or dissolve the fouling trapped therein.

One proposal for overcoming this problem that has been advanced suggests the use of a mixture by volume of half "Sweet's" bore cleaner (a product described in U. S. Pat. No. 5,565,039 granted on Oct. 15, 1996 to John H. Wagenknecht et al. for "Method For Dissolution Of Soft Metals From a Substrate Of A Harder Metal" and incorporated by reference herein) with AEROKROIL (a product produced by Kano Laboratories, Inc., 1000 E. Thompson Lane, Nashville, Tennessee 3721) "Kroil," (or Aerokroil)[1] is, as mentioned above, described in the Kano Laboratories, Inc. Jun. 7, 2005 "Safety Data Sheet," also incorporated by reference herein. "Kroil." Further in this respect, a combination by volume of 2/3 Sweet's; 1/3 Kroil; and added "GM Top engine cleaner" also has been tried. Nevertheless, these mixtures have failed to provide a truly satisfactory vehicle for penetrating rifle barrel fissures and the like.

The "Safety Data Sheet" identifies the product as "Aerokroil," which is "Kroil" packaged as an aerosol, which has no bearing on the physical and chemical characteristics of the underling penetrating lubricant.

Accordingly, the need continues for a better bore cleaning compound.

BRIEF DESCRIPTION OF THE INVENTION

A combination by volume of 6 ounces of Sweet's and 2.5 ounces of Kroil, that is, a mixture by volume percentage of approximately 70% Sweet's and 30% Kroil or 2.4 Sweet's to 1 Kroil has been found to produce remarkably superior results.

DETAILED DESCRIPTION OF THE PREFERRED EMBODIMENTS

Figure 1:
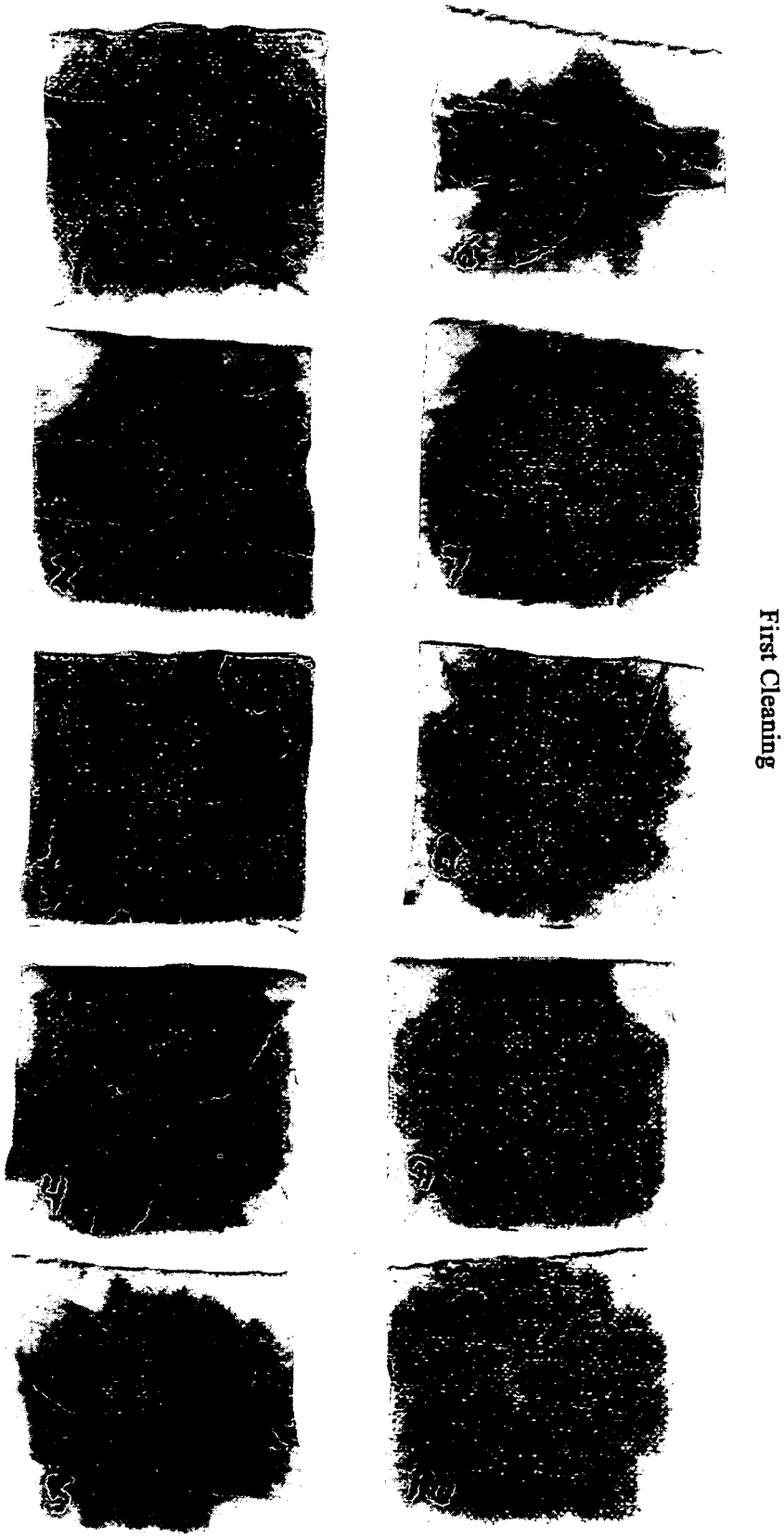
FIGS. 1 and 2 compare successive bore cleaning patches and the residues adhering to these patches using a prior art bore cleaning fluid to produce a superficially "clean" patch with a supplemental set of patches soaked in the bore cleaner that characterizes the invention to illustrate the quantity of fouling remaining in an apparently "clean" barrel that was removed through the practice of the invention.
Figure 2:
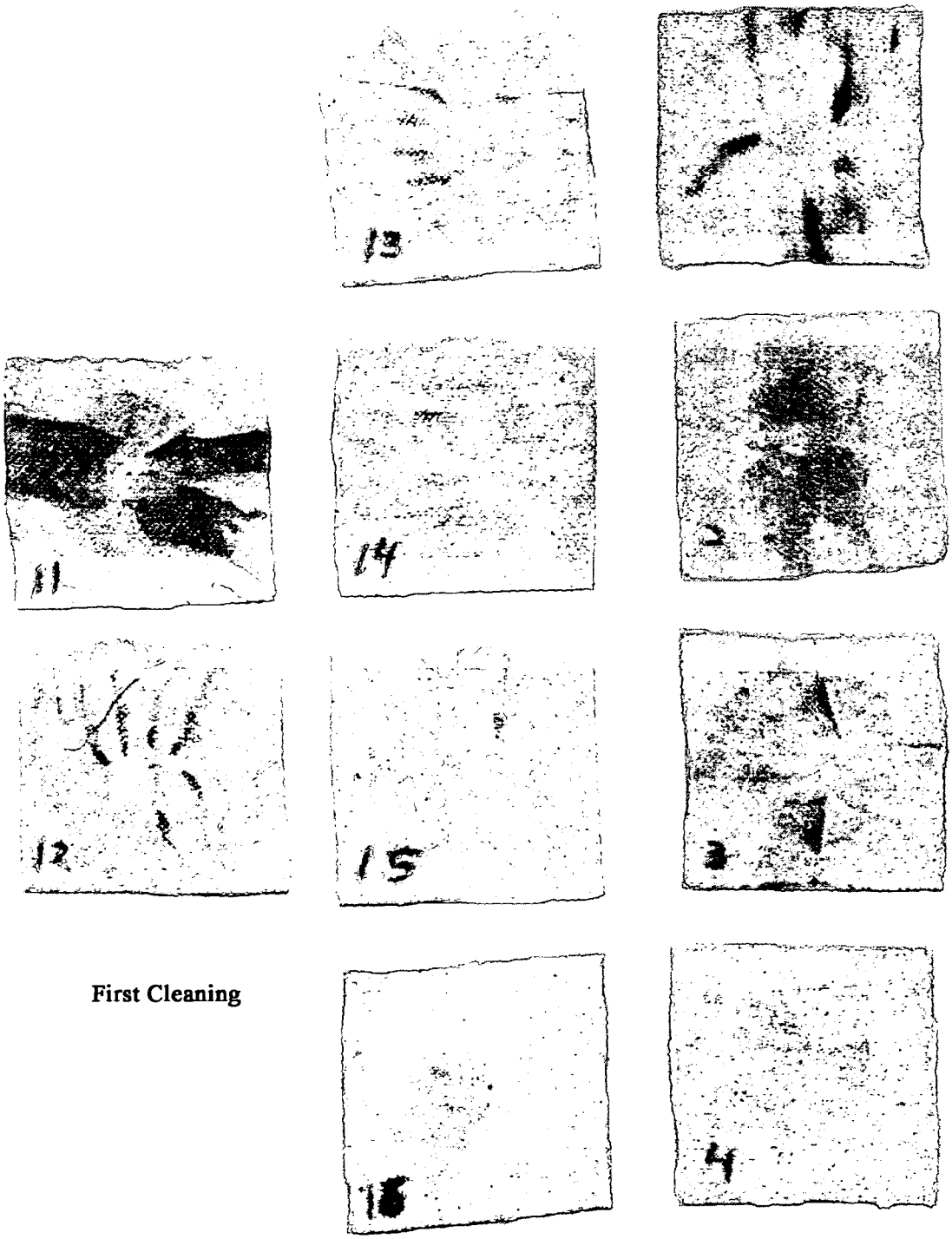

The disadvantages of the prior art are largely overcome through practice of the invention. For example, it has been found that a mixture by volume of about 70% Sweet's and 30% Kroil, with no further additives produce the surprising result shown in photographs 1/2 and 2/2.

Numbered cotton flannel patches 1 through 15 illustrated in photograph 1/2 and 2/2 each were first soaked in Sweet's and run successively through the bore of a very dirty World War II .30 caliber Mauser rifle. Each of the patches 1 through 15, moreover, was used only once.

Sequential patch 16, shown in photograph 2/2 was soaked in Kroil and run once through the bore, patch 16 passing through the bore and emerging from the bore in an apparent "clean" condition.

Immediately thereafter, patch 1 in photograph 2/2 was soaked in a mixture by volume of 6 ounces of Sweet's and 2.5 ounces of Kroil (e.g. a ratio of 2.4 Sweet's to 1 of Kroil, or approximately by volume 70% Sweet's and 30% Kroil) and passed once through the bore to emerge therefrom in the condition shown in photograph 2/2. The quantity of fouling that adhered to patch 1 in photograph 2/2 was about equal to that which attached to patches 8 or 9 in photograph 1/2.

Note in this respect that the dark stripes on the patches as shown in the photos correspond to copper projectile jacketing and the lighter gray matter adhering to the patches is a powder residue, all of which have been removed from the bore.

Using the Sweet's/Kroil composition illustrative of the invention are results as exemplified through patches 1 through 4 in photo 2/2. Each of these four patches were soaked with the compound and subjected, sequentially once through the bore, the fourth patch (patch 4) emerging from the bore in a truly clean condition.

Unquestionably, treatment with fifteen patches soaked in Sweet's and one final Kroil—soaked patch failed to scour all of the fouling from the rifle bore. In contrast, applicant's composition was able to seep into fissures and other otherwise inaccessible parts of the rifle bore to dissolve or otherwise draw out a considerable quantity of fouling that escaped the action of other bore cleaning compositions.

An attempt to combine further additives with the 70% Sweet's/30% Kroil composition was not successful. For instance, 91% isopropyl alcohol was added to the 6 ounce Sweet's/2.5 ounces Kroil mixture and was found to be unsatisfactory. This mixture with alcohol, for example, separated after a few hours.

More particularly, the Sweet's product composition as defined in John H. Wagenknecht et al. U.S. Pat. No. 5,565,039 granted Oct. 15, 1996 for "Method For Dissolution Of Soft Metals From a Substrate Of A Harder Metal" which '039 patent has been incorporated by reference herein. As best described in terms of the general chemical compounds and their respective physical functions, the composition includes an organic nitrocompound chosen from among the group identified in the '039 patent, which, when exposed to a soft metal (e.g. lead, copper) deposited on a harder metal (e.g. steel) surface oxidizes the soft metal to form a first soft metal salt. Carboxylic acid, when exposed to the first soft metal salt reacts with the first soft metal salt to form a second soft metal salt that is soluble in the composition, thereby removing the soft metal from the surface of the harder metal.

This composition, however, fails to remove those soft metal deposits that are lodged in hard-to-reach places, e.g. fouling trapped within hairline cracks, rifle barrel, fissures, or stuck in the angle between the grooves and the lands of a rifle barrel.

By mixing the foregoing compound with "Kroil," a penetrant lubricant described in Kano Laboratories, Inc. "Safety Data Sheet" dated Jun. 7, 2005 in the volume ratios described above with respect to the "Sweet's" compound, and in the absence of any other additions, the results are obtained that are so graphically illustrated in photograph sheets 1/2 and 2/2. This penetrant lubricant is best defined through the following physical properties, as specified in the Jun. 7, 2005 "Safety Data Sheet:"

Appearance and Odor: Slightly reddish liquid with a refreshing odor pH: 6 to 7

Boiling Point: 258° F.

Vapor Pressure: 12 mm of mercury at 20° C.

Vapor Density: Greater than 1 (air =1)

Specific Gravity: 0.87

Melting Point: not applicable

Water Solubility: negligible

Evaporation Rate: Less than 1 (ether =1)

The important feature of "Kroil" as an additive is not a chemical reaction with the second salt produced by the "Sweet's" fluid with which it is mixed, but its physical characteristics as a penetrant that seeps into hairline cracks and difficult-to-reach parts of the hard metal substrate in order to carry off the dissolved second soft metal salt. Consequently, it is the physical properties of "Kroil" as enumerated above (e.g. vapor pressure and specific gravity) that are essential to the superior cleaning activity of this invention.

Attempts to combine further additives with the 70% Sweet's / 30% Kroil composition were not successful. For instance, 91% isopropyl alcohol was added to the 6 ounce Sweet's / 2.5 ounces Kroil mixture and was found to be unsatisfactory. This mixture with alcohol, for example, separated after a few hours.

What is claimed is:

1. A cleaning compound with a fluid composition that includes an organic nitrocompound for dissolving soft metal from a hard metal substrate and that oxidizes the soft metal to form a first soft metal salt and a carboxylic acid for reacting with the soft metal salt to form another soft metal salt that is soluble in the fluid composition consisting of an approximate penetrant lubricant mixture with the fluid composition of 2.4 by volume of the fluid composition to 1 of said penetrant lubricant said penetrant lubricant having a pH of 6 to 7, a boiling point of 258° F., a vapor pressure of 12 mm of mercury at 20° C., a vapor density greater than air, an evaporation rate less than ether, and a specific gravity of 0.87.

2. A cleaning compound with a fluid composition that includes an organic nitrocompound for dissolving soft metal from a hard metal substrate and that oxidizes the soft metal to form a soft metal salt and a carboxylic acid for reacting with the soft metal salt to form another soft metal salt that is soluble in the fluid composition consisting of an approximate penetrant lubricant mixture with the fluid composition of 70% by volume of the fluid composition to 30% by volume of said penetrant lubricant, said penetrant lubricant having a pH of 6 to 7, a boiling point of 258° F., a vapor pressure of 12 mm of mercury at 20° C., a vapor density greater than air, an evaporation rate less that ether and a specific gravity of 0.87.

3. A cleaning compound with a fluid composition that includes an organic nitrocompound for dissolving soft metal from a hard metal substrate that oxidizes the soft metal to form a first soft metal salt and a carboxylic acid for reacting with the soft metal salt to form another soft metal salt that is soluble in the fluid composition consisting of an approximate penetrant lubricant mixture with the fluid composition that is proportionate to 6 ounces by volume of the fluid composition and 2.5 ounces by volume of said penetrant lubricant, said lubricant having a pH of 6 to 7, a boiling point of 258° F., a vapor pressure of 12 mm of mercury at 20° C., a vapor density greater than air, an evaporation rate less than ether and a specific gravity of 0.87.

* * * * *